United States Patent [19]
Bohlin et al.
[11] 4,294,412
[45] Oct. 13, 1981

[54] METHOD AND APPARATUS FOR CONTROLLING WOOD PULP GRINDING MACHINES

[75] Inventors: Karl G. Bohlin, Sundsvall; Borje I. Fredriksson, Matfors; Kent A. B. Karlsson; Lars T. Nelvig, both of Sundsvall, all of Sweden

[73] Assignee: SCA Development Aktiebolag, Sweden

[21] Appl. No.: 79,486

[22] Filed: Sep. 27, 1979

Related U.S. Application Data

[63] Continuation-in-part of Ser. No. 864,231, Dec. 27, 1977, abandoned.

[30] Foreign Application Priority Data

Dec. 27, 1976 [SE] Sweden ..... 7614558
Dec. 27, 1976 [SE] Sweden ..... 7614559

[51] Int. Cl.[3] ..... B02C 25/00
[52] U.S. Cl. ..... 241/30; 241/33; 241/282
[58] Field of Search ..... 241/30, 33, 37, 282

[56] References Cited

U.S. PATENT DOCUMENTS

| | | | |
|---|---|---|---|
| 3,690,568 | 9/1972 | Alexander | 241/282 X |
| 3,693,891 | 9/1972 | Remmer | 241/282 X |
| 3,776,475 | 12/1973 | Perry | 241/33 |
| 3,815,763 | 6/1974 | Biloco et al. | 241/282 X |
| 3,947,668 | 3/1976 | Al-Shaikh et al. | 241/33 X |

FOREIGN PATENT DOCUMENTS

| | | | |
|---|---|---|---|
| 341866 | 1/1972 | Sweden . | |
| 373172 | 1/1975 | Sweden . | |
| 151691 | 3/1932 | Switzerland . | |
| 328558 | 1/1972 | U.S.S.R. | 241/33 |
| 514630 | 6/1976 | U.S.S.R. | 241/33 |

OTHER PUBLICATIONS

"Operating Model of a Grinder" by H. Paulapuro, No. 1, 1976, *Papper Och. Tra.*
"Grinding Mechanism and Relation of Energy and Pulp Quality", D. Alexander, Paper Trade Journal, 8–9, 1971, pp. 26–29.
"Analysis of Grinding Variables", J. Bergstrom et al., Svensk Papperstidning, No. 11, 6–15, 1957.
"Pulp and Paper Chemistry and Chemical Technology", J. Casey, (N.Y., 1960), vol. 1, 2nd Edition.

*Primary Examiner*—Howard N. Goldberg
*Attorney, Agent, or Firm*—Lerner, David, Littenberg & Samuel

[57] ABSTRACT

Disclosed herein are apparatus and method for measuring, during operation, the degree of sharpness of grindstones in a wood pulp grinding machine of the type where one motor drives two grindstones, each having two or more pockets for loading timber. In accordance with the apparatus and method, the power of the motor and the feed rates of the pockets are simultaneously measured. After a predetermined time interval, during which the operating conditions of the machine change, these measurements are made again. The degree of sharpness of the grindstones can then be calculated using the measured values of power and feed rates.

28 Claims, 2 Drawing Figures

METHOD AND APPARATUS FOR CONTROLLING WOOD PULP GRINDING MACHINES

CROSS-REFERENCE TO RELATED APPLICATION

This is a continuation-in-part of U.S. Pat. application Ser. No. 864,231, filed Dec. 27, 1977, now abandoned.

FIELD OF THE INVENTION

The present invention relates to apparatus and method for producing mechanical paper pulp in wood pulp grinding machines of the type which have two grindstones on the same motor shaft, i.e., a Great Northern type grinder, and, more particularly, to such apparatus and method which are especially adapted to measure the degree of sharpness of the grindstones during the operation of the machines.

BACKGROUND OF THE INVENTION

Inasmuch as the manufacture of ground wood pulp has been known for over 100 years, a detailed discussion of the manufacturing procedure is not necessary. Briefly, grindstones are used to grind logs into wood pulp. During this grinding operation, the grindstones gradually become worn, and, therefore, they must be dressed or sharpened. The degree of sharpness affects both the characteristics of the pulp and, of course, the power consumption of the motor which drives the grindstones.

Heretofore, it has been the task of the operating personnel to decide when the various grindstones in a grinding mill should be sharpened and how to formulate a strategy for sharpening the grindstones. Since this is a rather difficult and complicated task, in view of the pulp quality and the power consumption per ton of pulp, as well as the output per hour, being affected in a rather complicated manner which is not completely understood, objective criteria are desired to aid the operating personnel in making these decisions.

In view of the present demanding requirements for good and reproducible wood pulp quality (the strength of newsprint, for example, in modern rotary presses is an essential, limiting factor for the printing speed), it has become extremely important to be able to maintain good process control in wood pulp mills, so that uniform and dependable quality can be achieved. The production of uniform wood pulp quality and hence uniform paper quality is especially important in the production of newsprint, inasmuch as newspaper presses must be set for the lowest strength newsprint which might ever be run. Thus, the printing speed of such presses depends largely on the lowest strength newspring which might be run, rather than the average strength which may be quite high. By manufacturing newsprint of a more uniform quality, higher printing speeds can be utilized.

The problem of monitoring the gradual change in the sharpness of grindstones in wood pulp mills has been addressed in the past. A device is disclosed in Swiss Patent Specification 151 691 in which the wood feed is measured at a constant feeding pressure and motor power consumption, thereby deriving a measure of the sharpness of the grindstone. The grinder disclosed in the Swiss Patent Specification is of the Stetig-Schleifer type and has only a single continuously operating pocket, which operates by way of a servo system so that the load on the motor driving the grindstone remains constant.

However, measuring the degree of sharpness of grindstones in a Great Northern type grinder, which has two different grindstones, each with two pockets, coupled by a common shaft to a single motor, is significantly more complicated than measuring the degree of sharpness of a grindstone of a Stetig-Schleifer type grinder. A conceivable method using the device disclosed in the Swiss Patent Specification would be to shut off the feed to the pockets of one of the grindstones and then measure the feed pressure and the load on the motor when only one of the grindstones is in operation. Such a theoretical measuring operation is, however, virtually impossible to carry out during operation of a Great Northern type grinder, since it would involve, among other things, the motor being driven at lower power, often at less than half power, thereby giving rise to control problems, or increasing the feed pressure, thereby producing a different and inferior quality pulp during the measuring operation. Accordingly, such a theoretical measuring operation is impractical when continuous production is required.

In order to improve the operating conditions and achieve a better and more uniform pulp quality, the degree of sharpness of the grindstones should be continuously, or almost continuously, monitored during their continuous operation. This would facilitate the formulation of grindstone sharpening strategies.

Basically, there are two important factors to consider when developing a strategy for sharpening grindstones. These are: (i) high capacity and (ii) optimum use of the available power of the motor.

During operation, the grindstones become worn, i.e., less sharp. A freshly dressed stone has fewer abrasive particles in operation. All other conditions being the same, this means a reduced load on the motor and a lower output per unit of time, but, on the other hand, a lower energy consumption per ton of pulp produced. Although the latter result is advantageous per se, the time delay for dressing and the problem of achieving a uniform quality when starting up after dressing present an optimization problem as to when re-dressing is to be done.

It is known and described in, for example, the article on pages 409–411 in Svensk Papperstidning by J. Bergstrom et al., entitled "Analysis of Grinding Process Variables", No. 11, June 15, 1957, that the output of a grindstone is proportional to the square of the power. The factor of proportionality varies with the degree of sharpness of the stone. This factor of proportionality is designated S. If the power is designated P, and if there is selected as a measure of output the rate of wood fed down against the grindstone and call this variable h, the following generally valid equation is obtained:

$$P^2 = h/S \quad (1)$$

This equation has been confirmed by various investigations, both by the assignee of this application at Ortvikens Träsliperi in Sundsvall and in a larger foreign investigation, the so-called Camel project, reported by D. K. Alexander in Paper Trade Journal, Aug. 9, 1979, p. 26. These investigations establish that the exponent in equation (1) is close to 2 with minor variations. This corresponds quite well with results from grinding in general.

With reference to FIG. 1 of the drawings, there is shown a graph which illustrates how output or production varies with variations in the sharpness of a grindstone, as represented by the proportionality or stone-wood factor (S). More particularly, the perpendicular axes show the production in tons per grinding day and the sharpness or stone-wood factor (S) in arbitrary units, respectively. Further, there are illustrated two families of curves, namely, solid line curves for specific energy consumption (MW/tons) and broken line curves for motor power (MW). The curves for three different process strategies are also illustrated, namely, for keeping constant energy per produced ton of pulp, constant production (tons per grinding day) and constant power. It can be seen that starting with a sharpened stone in the first-mentioned strategy, i.e., constant energy, productivity gradually increases with increased power requirements as the stone-wood factor (S) decreases, i.e., as the grindstone becomes worn. Further, it can be seen that if production is kept contant, both power requirements and specific energy consumption increase as the stone-wood factor (S) decreases. If constant power is to be drawn, it can be seen that production decreases and specific energy consumption increases as the stone-wood factor (S) decreases.

As indicated above, the quality of the pulp obtained is dependent on the grinding conditions. However, no direct measurement of the quality of the pulp is possible during operation. Rather, what must be resorted to are measurements of freeness. These are made by a well-known standard method designated CSF (Canadian Standard Freeness), in which measurements are taken directly on the fiber slurry obtained as a result of the grinding operation. Although what one is primarily interested in is actually the quality of the paper which is to be made, all experience shows that control to a constant CSF value provides entirely adequate paper quality control, since the tearing resistance correlates well with the CSF value.

Of the control principles for grinders which have been suggested, namely, constant piston pressure, constant rate of feed and constant power, tests have shown that the most advantageous for uniform quality is constant rate of feed. The advantage lies in the fact that a newly dressed stone, which otherwise has a tendency to produce coarse pulp, does not produce such coarse pulp when the feed rate is maintained constant, thus producing the most uniform pulp. However, the power consumed at the end of the period between two successive stone dressing operations is relatively large. If more than one grinder is in operation so that the pulp produced is a product of all of the grinders, it has been found that the feed rates need not be strictly maintained at constant values.

It has also been found, and is actually the basic principle for operation of grinders of Great Northern type, i.e., grinders with two grindstones mounted on a common motor shaft, that the two grindstones be dressed alternately, so that the power consumption is kept fairly constant. If one grindstone approaches the end of its sharpness cycle, i.e., becomes dull, and hence draws a relatively large amount of power, the other one at least is only half worn and therefore draws less power. Therefore, it is of great importance, especially for establishing an automatic process control, that the operating personnel of a mill be able to measure, during operation, the sharpness of the grindstones and to formulate a plan as to when the worn grindstones should be dressed or sharpened.

SUMMARY OF THE INVENTION

In accordance with the present invention, new and improved apparatus and method are provided which measure, preferably during the grinding operation, i.e., without a break in production, the degree of sharpness for grindstones in wood pulp grinders of the Great Northern type, i.e., grinders having at least two pockets per grinder and two grindstones coupled by a common shaft to a single driving motor. The improvement involves simultaneously measuring the power of the motor and the feed rates of the pockets at a first point in time and then, at a second point in time which is long enough after the first point in time to permit changes in the operating conditions of the grinder, repeating these measurements. The degree of sharpness of the grindstones is then calculated from these measure values of power and feed rates.

Another novel feature of the invention is that at the end of the wear cycle for each grindstone, i.e., when it is dull but not yet ready for dressing, it is used with only one pocket in operation. Operating only a single pocket compensates for the relatively high energy consumption by the dull grindstone and, at the same time, exploits the higher productivity of such a stone, admittedly, however, with a higher energy consumption per ton of ground wood. To what degree this feature is to be used is a question which must be answered taking into account all of the grinders in the plant and the output or production requirements. Often, the grinding mill is a direct link in a chain of production with continuous delivery to a papermaking machine.

The degree of sharpness $S_i$, where i designates the assigned ordinal number of each pocket, may be calculated from these measured values by inserting the values from each of the measurement occasions into the equation:

$$P = \sum_{i=1}^{n} \left( \frac{k_i}{S_i} \cdot h_i \right)^{\beta} \cdot f_i$$

$k_1$ = constants for the various pockets, which are dependent on the geometry of the pockets and are equal to 1 if all of the pockets are alike, $\beta$ = an empirical constant close to 0.5, $f_i$ = 1 when the pocket i is in grinding operation and = 0 when it is out of operation.

An equal number of equations are obtained as the number of measuring occasions. The values of the degrees of sharpness can be derived by solving the system of equations. It is also possible to compute a sliding average of the measured values for the degrees of sharpness of the grindstones.

It is preferable to select as measuring occasions points in time when the pockets are not in grinding operation, or when the grinding operation must be interrupted to retract the piston because of logs jammed transversely in the pocket, etc. It is also possible, for the sake of measurement, to temporarily change the prevailing feed pressure in a pocket.

A further check on the gradually changing grinding process is possible by computing the degree of sharpness individually for each pocket. In this way, the operating conditions in each pocket can be kept track of and it can be determined, for example, whether the water shower is functioning satisfactorily. However, if everything is functioning normally, the degree of sharpness will be the same for all of the pockets of the same grindstone.

BRIEF DESCRIPTION OF THE DRAWINGS

For a more complete understanding of the invention, reference may be had to the following detailed description taken in conjuction with the accompanying figures of the drawings, in which.

DESCRIPTION OF AN EXEMPLARY EMBODIMENT

Figure 1:
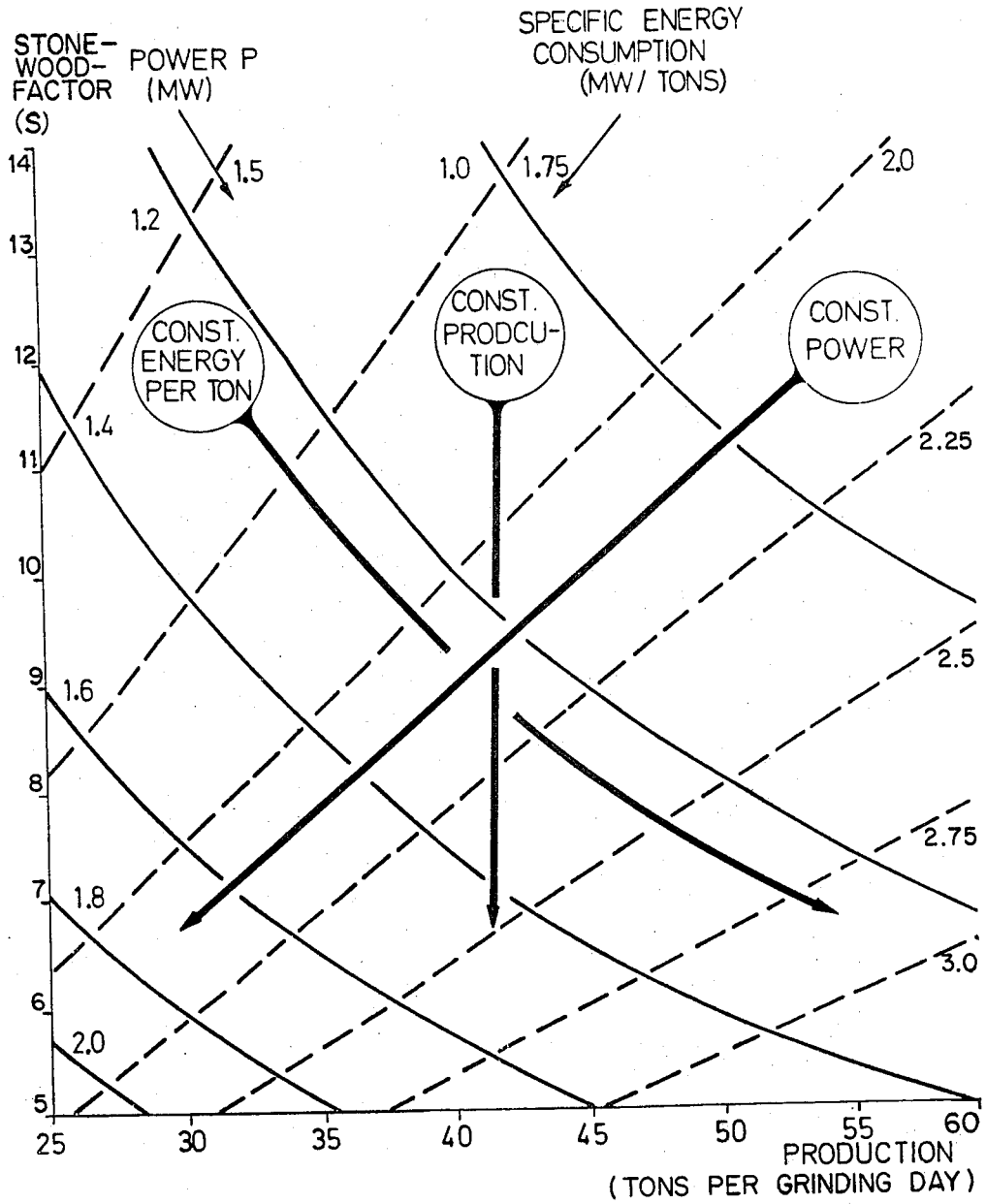
FIG. 1 is a graph showing the relationship between stone sharpness and production, as well as the parameters power and specific energy consumption.
Figure 2:
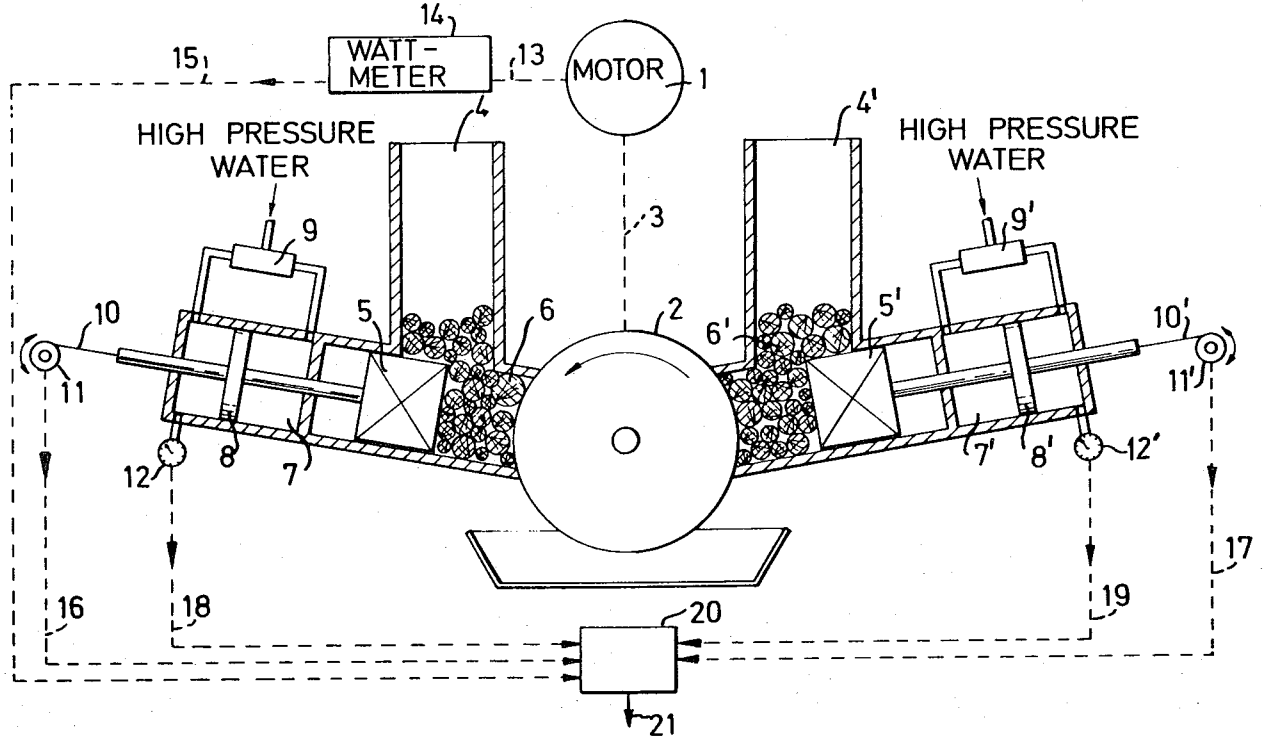
FIG. 2 is a schematic representation of a Great Northern type grinder constructed in accordance with the present invention.

With reference to FIG. 2, there is shown schematically a Great Northern type grinder. In this type of grinder, a motor 1 drives two grindstones 2 on a common shaft 3. Only one of the grindstones 2 is shown in the schematic drawing, which should be sufficient for explanation purposes, in view of well-known construction of such grinders in the papermaking art.

Each of the grindstones 2 is provided with a pair of magazines 4, 4', in which logs are fed to the grindstones 2. More particularly, the magazines 4, 4' are fed with logs from above, the logs being supplied from the magazines 4, 4' to pockets 6, 6', respectively, where plungers 5, 5' press the logs supplied from the pockets 6, 6', respectively, against the grindstone 2. Plungers 5, 5' can be reciprocated by means of cylinders 7, 7', respectively, and pistons 8, 8', respectively, under the control of valves 9, 9', respectively, which regulate the flow of high-pressure water fed from pumps (not shown).

As shown, both of the pockets 6, 6' are in their grinding positions. When the wood in the pockets 6, 6' is almost ground up, the cylinders 7, 7' are reciprocated and new logs will then fall down by gravity from the magazines 4, 4' into the pockets 6, 6'. As the pockets 6, 6' will normally not finish grinding at the same time, this reciprocation affords an excellent opportunity to measure the power of the motor 1 and the feed rates of the pockets 6, 6' in accordance with the method of the present invention, since the reciprocation of one of the cylinders 7, 7' creates a changed condition in which grinding is carried out in only three pockets, followed by another changed condition in which grinding is, once again, carried out in four pockets.

The motor 1 is a three-phase asynchronous motor. The line voltage is 6 kV AC (50 p/s). As is well-known, it is sufficient in such a motor to known two voltages and two currents out of the three in a three-phase system. There are, for this purpose, two transformers which transform an AC voltage from 6600 V to 110 V AC. Further, two of the phase lines are led through current transformers, giving for 800 A an output current of 5 A. The two transformed voltages and the two transformed currents are fed to a wattmeter 14, such as one manufactured by Camille-Bauer Messinstrumente AG, Wohlen, Switzerland, and identified as model TYP 56-7P/Q1-0922. The wattmeter 14 generates two ouput signals of 0–20 mA, giving a measurement of the active and reactive power of the motor 1 at any moment in time. The reactive power measurement is not, at present, used but may be of importance if it is necessary to limit the total reactive load of the plant, the maximum reactive load being important in determining the price of electrical power. The value of the active power of the motor 1 is directly used in the method of the present invention.

As to the feed rates of the pockets 6, 6',these are measured by coupling each of the plungers 5, 5' to one end of strings 10, 10', respectively the other end of the strings 10, 10' being rolled up on spring-loaded drums 11, 11', respectively. Each of the drums 11, 11' is fixed to a shaft which is connected to the shaft of an ordinary multi-turn potentiometer. Such potentiometers are readily available in the market and sold, for example, under the trademark "Helipot".

Output signals 16, 17 of these multi-turn potentiometers will provide an easily measurable resistance value proportional to the position of the plungers 5, 5'. The rate of change of this value will provide a value of the plunger speed. A conventional derivate-delivering circuit, which is commonly known in the electronics art, will provide a measure of this rate of change, e.g., in the form of a voltage.

The pressure of the pistons 8, 8' may be measured by pressure sensors 12, 12', respectively, coupled to the pressurized side of the cylinders 7, 7', respectively. The sensors 12, 12' generate appropriate signals on lines 18, 19, respectively.

By this construction, it is possible at any moment in time to obtain a value of the motor power P from the wattmeter 14 and simultaneously a value of the feed rate $h_i$ of each pocket which is performing a grinding operation. According to the invention, these values are measured for two different points in time, between which the operating conditions are changed. As indicated above, an advantageous opportunity for making these measurements is presented during pocket refilling, which occurs quite frequently. Of course, it is also possible to change the operating conditions in other ways, but they would not have the advantage of being made in the regular operation during pulp wood manufacture.

According to one embodiment, the data on motor power and pocket speed are continuously recorded by means of conventional recorder hardware. It is then possible for the operating personnel to keep track of the sharpness of each of the grindstones 2. In fact, it is possible to obtain a useful value of sharpness by looking at the values for merely one refilling of a pocket by noting the power difference before and during refill. The short elimination of a pocket will lead to a power decrease, and as that pocket's speed or feed rate $h_i$ is known, the sharpness value can be calculated directly by means of equation (5) below.

According to another, more sophisticated embodiment, the values of the sharpness of the two grindstones 2 are automatically kept updated by a numerical computer 20, which gives the further advantage that measuring errors can be eliminated by averaging. If, in the course of calculating a new average, each new measurement replaces the oldest measurement used in the preceding average, a sliding average signal 21 is obtained.

It is well known in the art that the success of pulpmaking depends, to a high degree, on the individual skill of the operating personnel. For instance, there are several variables which have to be continually controlled, like the amount of water sprayed on the grindstones 2 in order to obtain a suspension and cool the stones. The sharpness measured for the grindstones 2 is not exactly independent of this showering, and the motor power and feed rate measurements make it possible to maintain such a variable constant. The constant surveillance of the sharpness of the grindstones 2 also facilitates the optimization of operating conditions, which heretofore has been possible to obtain only by the use of very skilled engineers with years of experience in pulpmaking, who have obtained through this experience a subjective feel for what should be done to obtain the best results.

The grinder may be the one manufactured by the Finnish company Tampella Oy. Depending on the conditions, the motor power could vary between 1.5 and 15 MW. As previously explained, it is considered most advantageous to sharpen the two grindstones 2 alternately, so that the newly sharpened stone, which gives low production and low power consumption, is suitably balanced by an unsharpened stone, which consumes more power.

According to one embodiment of the invention which is presently in operation at Ortvikens Paper Mill in Sundsvall, there are nine pairs of grindstones driven by nine motors, five of which have a maximum power of 5.5 MW, the other four having a maximum power of 4.5 MW. Each motor grinds wood in four pockets. In each pocket, there is ground, on the average, about 1 ton of wood per hour. The logs have a length of 1.5 m, the pockets being about 60 cm deep and their pistons having a working stroke of 64 cm. Automatic refilling of the pockets occurs every 5–10 minutes, and as this happens at different times for the different pockets of each motor, there are normally about 40 incidences per hour when motor power and feed rate measurements can be made during the normal grinding operation.

It is obviously possible to perform by hand the necessary measurements of motor power P and the different cylinder speeds before and after refilling, e.g., by having an individual read the different values and make the appropriate calculation, e.g., according to equation 5 below. However, it is preferred to make these measurements automatically using the computer 20, which can be easily programmed by a person skilled in the computer art.

The values of sharpness for each grindstone may thus be calculated over the several days normally passing between sharpenings. Each stone tends to load its motor, when newly sharpened, at a power of about 1 MW and, when dull, at a power of about 2.1 MW. By the invention, it is possible to plan the sharpenings so that each pair of stones performs its grinding operation at near maximum power. Furthermore, it is possible to optimize the sum of powers of all the motors in the plant. Such optimization can reduce the average energy demand per ton of pulp from about 1100 kw/ton to about 1000 kw/ton. This is in addition to a slightly better quality pulp, so that the necessary addition of chemically manufactured pulp, which has longer fibres, can be decreased. The improved uniformity of quality of the mechanically produced pulp thus leads to an important saving, as lesser amounts of the more expensive chemically produced cellulose fibers can be added without dropping the minimum strength of the paper below safe or minimum limits.

For any pocket i of the grinder illustrated in FIG. 2, there can be derived from equation (1) above, the following equation:

$$P_i = \left(\frac{k_i}{S_i} \cdot h_i\right)^{\beta} \tag{3}$$

where $P_i$ is the power consumed for grinding in this pocket, $S_i$ is the prevailing degree of sharpness for this stone (and this pocket), $h_i$ is the feed rate for the pocket, and $k_i$ is a characteristic constant (which can depend on the grinding area, for example) for the pocket. The constant $k_i$ can in general be set equal to 1. The exponent $\beta$ has been shown by experience to be almost constant and can, as a rule, be set equal to $\frac{1}{2}$.

The values $S_i$ can now be calculated. As described in detail above, the feed rate $h_i$ can be measured relatively simply. The power $P_i$ is unknown however. During operation only the total power from the motor is known, i.e., measurable in the manner described above. It might be possible to measure the load distribution between the stones by inserting a torque meter on the shaft between the two grindstones. There is, however, no practical and reliable way of doing this. Also, this would only partially solve the problems involved in measuring the power $P_i$, since there are two pockets for each stone.

As discussed above, the total motor power P can be easily measured. Accordingly, the following equation can be written:

$$P = \sum_{i=1}^{4} \left(\frac{k_i}{S_i} \cdot h_i\right)^{\beta} \cdot f_i \tag{4}$$

where $f_i$ has the value 1 if the pocket i is in operation and the value 0 if it is not, e.g., for filling when the piston is retracted.

With reference to equation (4), it can be seen that there are four unknowns, namely, the values of $S_i$. If P and the four feed rates $h_i$ are measured at four different occasions, there will be a system of equations with four equations and four unknowns, which means that the system is, in principle, soluble. However, for acceptable accuracy, the four equations must differ to a sufficient degree. Otherwise, unavoidable errors in measurements would make the information content of the solutions low or non-existent.

If the quantities in equation (4) are measured immediately preceding and immediately after the pocket i is shut off, then the following equation applies:

$$P_{before} - P_{after} = \left(\frac{k_i}{S_i} \cdot h_i\right)^{\beta} \tag{5}$$

It should be understood that, under normal operating conditions, the degree of sharpness is the same for both of the pockets to the same stone. In this case, it is only necessary to deal with two unknowns. In principle, it is possible to derive values for the two unknowns with the aid of measurements at two different points in time, provided that the grinding conditions have changed sufficiently during the interval between these points in time. However, in practice, it has proved advantageous, during continuous production, to make these measurements at not less than four different points in time, thereby increasing the accuracy of the calculated values for the degrees of sharpness of the stones.

Numerically, the system of equations can be easily transformed by substitution into a linear system of equations with the unknown variables $(1/S_i)\beta$. The solution is then suitably obtained, if a computer is used, by matrix inversion. Since such methods of solution must be considered to be well-known to a person skilled in the computer art, it is not necessary to describe the mathematical methods in more detail.

Attached hereto as Appendix I is an exemplary computer program, written in FORTRAN, and adapted for use with the computer 20.

By the present invention, it is also possible to monitor and control output or production without making special measurements of water shower flow or temperatures. This is especially advantageous since temperature determinations are generally undependable and the great thermal inertia of the system makes representative instantaneous measurements difficult.

Being able to obtain numerical values for the degree of sharpness makes it also possible to achieve a more advantageous power load, by optimally distributing the motor power, and dressing the grindstones at a more nearly optimum point in time. It is also possible, due to a better understanding of the process variables, to allow one pocket of the duller stone, at the correct point in time, to operate alone during a portion of the wear cycle, producing a proven increase in output, theoretically as much as 30%.

The greatest advantage of the invention is, however, that by continuously calculating the degree of sharpness of the grindstones, it is possible to determine when each individual stone in the entire mill is to be dressed so as to optimize operation. The stones on one shaft should not both have a low or a high degree of sharpness, and, in certain cases, for instance, where the electric power subscription provides for a standard rate up to a certain load and a penalty fee if this is exceeded, the total power consumed by all of the machines in the mill should be controlled to be kept in the vicinity of but always below a maximum value.

In addition, there is the possibility of achieving better control of the paper quality due to the fact that an important parameter for predicting the paper quality and for setting the rest of the operating variables can be continuously monitored. Thus, a more nearly uniform product may be produced. For example, in the production of newsprint, small amounts of more expensive sulphite pulp are usually mixed into the mechanical pulp in order to improve the characteristics of the paper. With a more uniform pulp quality, this admixing can be reduced, thereby reducing the costs involved with the manufacture of the paper without deleteriously affecting its quality.

It will be understood by those skilled in the art that the above-described embodiment is meant to be merely exemplary and that it is susceptible of modification and variation without departing from the spirit and scope of the invention. Thus, the invention is not deemed to be limited except as defined in the appended claims.

APPENDIX I

```
C     PURPOSE
C     TO OBTAIN SOLUTION OF A SET OF SIMULTANE-
C     OUS LINEAR EQUATIONS. (AX=B)
C     CALLING SEQUENCE
C     CALL SIMQ(A,B,N,$LL)
C     A - MATRIX OF COEFFICIENTS STORED COL-
C     UMNWISE. THE MATRIX IS DSTROYED IN THE
```

-continued

APPENDIX I

```
C     COMPUTATION.
C     B - VECTOR OF ORIGINAK CONSTANTS. THESE
C     ARE REPLACED BY THE FINAL SOLUTION VAL-
C     UES.
C     N - NUMBER OF EQUATIONS AND VARIABLES.
C     LL - LABEL FOR ERROR RETURN IN CASE OF
C     SINGULAR MATRIX. MUST BE PRECEEDED BY
C     $-SIGN.
C     REMARKS
C     MATRIX MUST BE GENERAL. IF MATRIX IS SIN-
C     GULAR, THE SOLUTION IS MEANINGLESS.
C     METHOD
C     METHOD OF SOLUTION IS ELIMINATION USING
C     LARGEST PIVOTAL DIVISOR. EACH STAGE OF
C     ELIMINATION CONSISTS OF INTERCHANGING
C     ROWS WHEN NECESSARY TO AVOID DIVISION
C     BY ZERO OR SMALL ELEMENTS. THE FORWARD
C     SOLUTION TO OBTAIN VARIABLE N IS DONE IN
C     N STAGES. THE BACK SOLUTION FOR THE
C     OTHER VARIABLES IS CALCULATED BY SUCCES-
C     SIVE SUBSTITUTIONS. FINAL SOLUTION VALUES
C     ARE DEVALOPED IN VECTOR B, WITH VARIABLE1
C     IN B(1), VARIABLE 2 IN B(2),....., VARIABLE N IN
C     B(N). IF NO PIVOT CAN BE FOUND EXCEEDING
C     A TOLERANCE TOL, THE MATRIX IS CONSIDER-
C     ED SINGULAR AND RETURN IS MADE TO LL.
C     THIS TOLERANCE CAN BE MODIFIED BY RE-
C     PLACING THE FIRST STATEMENT.
C
C
      SUBROUTINE SIMQ(A,B,N,LL)
      DIMENSION A(16),B(4)
C
C     FORWARD SOLUTION
C
      TOL=0.0
      JJ=-N
      DO 65 J=1,N
      JY=J+1
      JJ=JJ+N+1
      BIGA=0
      IT=JJ-J
      DO 30 I=J,N
C
C     SEARCH FOR MAXIMUM COEFFICIENT IN COL-
C     UMN
C
      IJ=I T+I
      IF(ABS(BIGA)-ABS(A(IJ))) 20,30,30
   20 BIGA=A(IJ)
      IMAX=I
   30 CONTINUE
C
C     TEST FOR PIVOT LESS THAN TOLERANCE
C     (SINGULAR MATRIX)
C
      IF (ABS(BIGA)-TOL)35,35,40
   35 RETURN LL
C
C     INTERCH ROWS IF NECESSARY
C
   40 I1=J+N*(J-2)
      IT=IMAX-J
      DO 50 K=J,N
      I1=I1+N
      I2=I1+IT
      SAVE=A(I1)
      A(I1)=A(I2)
      A(I2)=SAVE
C
C     DIV EQUATION BY LEADING COEFFICIENT
C
   50 A(I1)=A(I1)/BIGA
      SAVE=B(IMAX)
      B(IMAX)=B(J)
      B(J)=SAVE/BIGA
C
C     ELIMINATE NEXT VARIABLE
C
      IF(J-N) 55,70,55
   55 IQS=N*(J-1)
```

-continued

APPENDIX I

```
      DO 65 IX=JY,N
      IXJ=IQS+IX
      IT=J-IX
      DO 60 JX=JY,N
      IXJX=N*(JX-1)+IX
      JJX=IXJX+IT
60    A(IXJX)=A(IXJX)-(A(IXJ)*A(JJX))
65    B(IX)=B(IX)-(B(J)*A(IXJ))
C
C     BACK SOLUTION
C
70    NY=N-1
      IT=N*N
      DO 80 J=1,NY
      IA=IT-J
      IB=N-J
      IC=N
      DO 80 K=1,J
      B(IB)=B(IB)-A(IA)*B(IC)
      IA=IA-N
80    IC=IC-1
      RETURN
      END
R
```

What we claim is:

1. A method of controlling the operation of a wood pulp grinding machine of the type which has at least two pockets per grindstone and two grindstones coupled by way of a common shaft to a single drive motor, comprising the steps of:

(i) simultaneously measuring the power of the motor and the feed rates of the pockets;

(ii) repeating step (i) after a predetermined time interval during which the operating conditions of the machine change as a result of the operation thereof;

(iii) calculating the degrees of sharpness of the grindstones using the power and feed rate values measured in steps (i) and (ii); and (iv) dressing each grindstone when its calculated degree of sharpness reaches a determined value.

2. A method according to claim 1, wherein said degrees of sharpness are calculated by inserting said power and feed rate values into the following equation:

$$P = \sum_{i=1}^{n} \left( \frac{k_i}{S_i} \cdot h_i \right)^{\beta} \cdot f_i$$

where n equals the number of pockets, $k_i$=constants for the different pockets, which are dependent upon their geometry and are equal to 1 if all are alike, $S_i$=the degree of sharpness, i designating the assigned ordinal number of each pocket, $h_i$=the feed rates of the pockets, i designating the assigned ordinal number of each pocket, $\beta$=an empirical constant close to 0.5, and $f_i$=1 when the pocket is in grinding operation and 0 when it is not, i designating the assigned ordinal number of each pocket.

3. A method according to claim 2, whereby said equation is used for each of said measuring steps, whereby the number of equations corresponds to the number of measuring steps.

4. A method according to claim 3, wherein said degrees of sharpness are calculated by simultaneously solving said equations.

5. A method according to claim 4, wherein in solving said equations an assumption is made that the degrees of sharpness for pockets located at the same grindstone are the same, whereby the number of measuring steps may be cut in half.

6. A method according to claim 3, wherein at the time of conducting at least one of said measuring steps the feeding pressure in a pocket is altered to obtain a greater independence between said equations, whereby the accuracy in their solution may be increased.

7. A method according to claim 3, wherein after each calculation of said degrees of sharpness, their mean values are calculated using the present and a specified number of immediately preceding calculations to obtain sliding averages, whereby measuring errors are decreased.

8. A method according to claim 1, wherein said measuring steps are carried out when the grinding in one of the pockets has been terminated.

9. A method according to claim 1, wherein the degree of sharpness is determined separately for each pocket, the number of measuring steps corresponding with the number of pockets, whereby it is possible to determine whether the grindstones are sufficiently showered by spray water.

10. A method of controlling the operation of a wood pulp grinding machine of the type which has two grindstones mounted on a single motor shaft, each grindstone being provided with at least two pockets, the grinding in each pocket being done so that the grinding pressure in each pocket is adjusted for a constant feed rate or constant specific energy consumption and the two grindstones are dressed alternately, comprising the steps of:

(i) simultaneously measuring the power of the motor and the feed rates of the pockets;

(ii) repeating step (i) after a predetermined time interval during which the operating conditions of the machine change as a result of the operation thereof;

(iii) calculating the degrees of sharpness of the grindstones using the power and feed rate values measured in steps (i) and (ii);

(iv) determining a first grindstone to be dressed as a function of the calculated degrees of sharpness of the grindstones;

(v) shutting off one pocket of the first grindstone to be dressed for a period of time prior to its dressing; and (vi) dressing the first grindstone to be dressed when its calculated degree of sharpness reaches a determined value.

11. A method according to claim 10, wherein said degrees of sharpness are calculated by inserting said power and feed rate values into the following equation:

$$P = \sum_{i=1}^{n} \left( \frac{k_i}{S_i} \cdot h_i \right)^{\beta} \cdot f_i$$

where n equals the number of pockets, $k_i$=constants for the different pockets, which are dependent upon their geometry and are equal to 1 if all are alike, $S_i$=the degree of sharpness, i designating the assigned ordinal number of each pocket, $h_i$=the feed rates of the pockets, i designating the assigned ordinal number of each pocket, $\beta$=an empirical constant close to 0.5, and $f_i$=1 when the pocket is in grinding operation and 0 when it is not, i designating the assigned ordinal number of each pocket.

12. A method according to claim 11, wherein said equation is used for each of said measuring steps, whereby the number of equations corresponds to the number of measuring steps.

13. A method according to claim 12, wherein said degrees of sharpness are calculated by simultaneously solving said equations.

14. A method according to claim 13, wherein in solving said equations an assumption is made that the degrees of sharpness for pockets located at the same grindstone are the same, whereby the number of measuring steps may be cut in half.

15. A method according to claim 12, wherein at the time of conducting at least one of said measuring steps the feeding pressure in a pocket is altered to obtain a greater independence between said equations, whereby the accuracy in their solution may be increased.

16. A method according to claim 12, wherein after each calculation of said degrees of sharpness, their mean values are calculated using the present and a specified number of immediately preceding calculations to obtain sliding averages, whereby measuring errors are decreased.

17. A method according to claim 10, wherein said measuring steps are carried out when the grinding in one of the pockets has been terminated.

18. A method according to claim 10, wherein the degree of sharpness is determined separately for each pocket, the number of measuring steps corresponding with the number of pockets, whereby it is possible to determine whether the grindstones are sufficiently showered by spray water.

19. Apparatus for controlling the operation of a wood pulp grinding machine of the type which has at least two pockets per grindstone and two grindstones coupled by way of a common shaft to a single motor, comprising first generating means for automatically generating a signal in response to the power produced by the motor; second generating means for automatically generating a signal in response to the feed rates of the pockets; calculating means for automatically calculating the degrees of sharpness of the grindstones from the signals generated by said first generating means and said second generating means; and dressing means for dressing each grindstone when its calculated degree of sharpness reaches a determined value.

20. Apparatus according to claim 19, wherein said first generating means includes a wattmeter electrically connected to the motor.

21. Apparatus according to claim 19, wherein said second generating means includes a plurality of potentiometers, each of which is mechanically connected to a plunger of a corresponding one of the pockets.

22. Apparatus according to claim 19, wherein said calculating means is a computer.

23. Apparatus for controlling the operation of a wood pulp grinding machine of the type which has two grindstones mounted on a single motor shaft, each grindstone being provided with at least two pockets, the grinding in each pocket being done so that the grinding pressure in each pocket is adjusted for a constant feed rate or constant specific energy consumption and the two grindstones are dressed alternately, comprising first generating means for automatically generating a signal in response to the power produced by the motor; second generating means for automatically generating a signal in response to the feed rates of the pockets; calculating means for automatically calculating the degrees of sharpness of the grindstones from the signals generated by said first generating means and said second generating means; determining means for determining a first grindstone to be dressed as a function of the calculated degrees of sharpness of the grindstones; shutting off means for shutting off one pocket of the first grindstone to be dressed for a period of time prior to its dressing; and dressing means for dressing the first grindstone to be dressed when its calculated degree of sharpness reaches a determined value.

24. Apparatus according to claim 23, wherein said first generating means includes a wattmeter electrically connected to the motor.

25. Apparatus according to claim 23, wherein said second generating means includes a plurality of potentiometers, each of which is connected mechanically to a plunger of a corresponding one of the pockets.

26. Apparatus according to claim 23, wherein said calculating means is a computer.

27. A method according to claim 10, further comprising the steps of shutting off one pocket of the second grindstone to be dressed for a period of time prior to its dressing and dressing the second grindstone to be dressed when its calculated degree of sharpness reaches a determined value.

28. Apparatus according to claim 23, wherein said shutting off means shuts off one pocket of the second grindstone to be dressed for a period of time prior to its dressing and said dressing means dresses the second grindstone to be dressed when its degree of sharpness reaches a determined value.

* * * * *